US011355054B2

(12) United States Patent
Li et al.

(10) Patent No.: US 11,355,054 B2
(45) Date of Patent: Jun. 7, 2022

(54) METHOD AND APPARATUS FOR DYNAMIC RANGE EXTENDER

(71) Applicant: SCT LTD., Grand Cayman (KY)

(72) Inventors: Eric Li, Milpitas, CA (US); Jim Wickenhiser, Milpitas, CA (US); Shang-Kuan Tang, Milpitas, CA (US)

(73) Assignee: SCT LTD., Grand Cayman (KY)

( * ) Notice: Subject to any disclaimer, the term of this patent is extended or adjusted under 35 U.S.C. 154(b) by 0 days.

(21) Appl. No.: 17/446,064

(22) Filed: Aug. 26, 2021

(65) Prior Publication Data

US 2022/0068186 A1 Mar. 3, 2022

Related U.S. Application Data

(60) Provisional application No. 63/070,669, filed on Aug. 26, 2020.

(51) Int. Cl.
*G09G 3/20* (2006.01)
*G09G 3/32* (2016.01)

(52) U.S. Cl.
CPC ..... *G09G 3/2014* (2013.01); *G09G 3/32* (2013.01); *G09G 2310/08* (2013.01); *G09G 2360/18* (2013.01)

(58) Field of Classification Search
CPC .... G09G 3/2014; G09G 3/32; G09G 2310/08; G09G 2360/18
See application file for complete search history.

(56) References Cited

U.S. PATENT DOCUMENTS

2005/0280615 A1* 12/2005 Cok ..... G09G 3/3216 345/77

* cited by examiner

*Primary Examiner* — Kenneth B Lee, Jr.
(74) *Attorney, Agent, or Firm* — Novick, Kim & Lee, PLLC; Allen Xue

(57) ABSTRACT

The LED display system includes an array of LEDs and a driver circuit. The driver circuit has a PWM engine, an adder, an accumulator, a multiplier, and a frame butter. The multiplier multiplies an image data of a first bit depth (PWM) with a multiple (M) to produce an input data (PWM_M) having a second bit depth. The multiple has an integer section ($M_I$) of one or more bit in length and a fraction section ($M_F$) of one or more bit in length. The input data has an integer section (PWM_$M_I$) and a fraction section (PWM_$M_F$). The adder adds a value of PWM_$M_F$ of a current input data with a value of a remainder in an accumulator. The PWM engine receives PWM data from the frame buffer and generates PWM pulses to drive the LED array.

14 Claims, 6 Drawing Sheets

Time
Frame #1
Frame #2
Frame #3
Frame #4
Frame #5
Frame #6
Frame #7
Frame #8
1/2
0
0
0
0
0
1/2
0
0
0
0
0
0
0
0
1
1
1
1
1
1
1
0
0
0
0
0
0
0
0

$T_1$

At time $T_1$, a new frame having five fraction sections emerges.

$T_0$

At time $T_0$, a current frame having five fraction sections stored in five accumulators $T_2$ At time $T_2$, the five accumulators along with the five carry-out bits store the outcome of an addition operation

METHOD AND APPARATUS FOR DYNAMIC RANGE EXTENDER

THE TECHNICAL FIELD

The present disclosure relates generally to methods and devices for driving an LED array. More particularly, this disclosure relates to methods and devices that enable extended grayscale values for LED display panels.

BACKGROUND

Modern LED display panels require higher grayscale levels (i.e., grayscale values, grayscale) to accomplish higher color depth and higher visual refresh rate to reduce flickering. For example, a 16-bit grayscale for a RGB LED pixel may allow 16 bit levels ($2^{16}$=65536) for R, G, B LEDs respectively. Such a RGB LED pixel is capable of displaying a total of $65536^3$ colors. One method commonly employed to adjust LED grayscale is PWM (Pulse Width Modulation). Simply put, PWM turns an LED ON or OFF according to the width of the signal pulse (i.e., pulse duration or pulse width). The ratio between the on time and the off time in turn determines the brightness of the LED. A different ratio represents a different grayscale. Configurations and operations of LED display systems, including LED topology, circuitry, PWM schemes and PWM engines are explained in detail U.S. Pat. No. 8,963,811 B2, filed Sep. 21, 2011.

Nowadays most of LED displays on the market has a 16-bit grayscale range, which is not sufficient to emulate the full range of brightness visible to human eyes. For example, the state-of-art LED display has a brightness range of from 0.1 Nits to 1,700 Nits. It is desirable to have a display that has a wider brightness range, e.g., one emitting light as bright as 10,000 Nits and as dim as 0.005 Nits. Therefore, methods and apparatus are needed to extend the brightness range of the LED display.

SUMMARY OF INVENTION

In one embodiment, there is provided an LED display system with an increased dynamic range. The LED display system includes a plurality of LEDs arranged into an LED array and a driver circuit configured to drive the array of LEDs. The LEDs (or LED pixels) can be either RGB LEDs or single color LEDs. The driver circuit includes a PWM engine, an adder (i.e., an adder circuit), an accumulator (e.g., a register), a multiplier (e.g., a binary multiplier circuit), and a frame buffer. The frame buffer may include a transmitter and one or more memories. The PWM engine receives PWM data from the frame buffer and generates a plurality of PWM pulses (or simply "pulses") to drive the LED array.

During operation, the multiplier multiplies an image data of a first bit depth (PWM) with a multiple (M) to produce an input data (PWM_M) having a second bit depth. The multiple has an integer section ($M_I$) of one or more bits in length and a fraction section ($M_F$) of one or more bits in length. The input data has an integer section (PWM_$M_I$) and a fraction section (PWM_$M_F$). The adder adds a value of PWM_$M_F$ of a current input data with a value of a remainder in an accumulator. The driver circuit operates to update the remainder to equal the sum of the addition. The driver circuit further operates to subtract integer one from the sum of the addition and update the remainder in the accumulator to equal a result of the subtraction when the sum of the addition equals to or is larger than integer one, and add integer "1" to a bit in PWM_$M_I$. The value of PWM_$M_I$ is sent to the frame buffer, which provides PWM data to the PWM engine to generate PWM pulses.

In one embodiment, the bit in PWM_$M_I$ that receives integer "1" from the adder is specifically designated for the receiving function and has a default value of zero. The adder fills the bit with integer "1" regardless of the current value stored in the bit.

In another embodiment, the PWM engine generates PWM pulses in a way in which a number of pulses are generated for each non-zero bit in PWM_$M_I$ and the number of pulses is in accordance with the designated value of the non-zero bit, no pulse is generated for each bit in PWM_$M_I$ that carries integer zero, and no pulse is generated for each bit in PWM_$M_F$ regardless of the value in each bit of PWM_$M_F$.

In still another embodiment, there is provided a method for increasing dynamic range of an LED display. The method includes the steps of multiplying an image data of a first bit depth (PWM) with a multiple (M) to produce an input data (PWM_M) having a second bit depth, wherein the multiple has an integer section ($M_I$) of one or more bit in length and a fraction section ($M_F$) of one or more bit in length, wherein the input data has an integer section (PWM_$M_I$) and a fraction section (PWM_$M_F$); conducting an addition operation on a value of PWM_$M_F$ of a current input data and the value of a remainder in an accumulator, when a sum of the addition operation is less than one, updating the remainder to equal the sum of the addition; when the sum of the addition equals to or is larger than integer one, subtracting integer one from the sum of the addition and updating the remainder to equal a result of the subtraction, and filling a bit in PWM_$M_I$ with integer one; and sending the value of PWM_$M_I$ to a frame buffer. The frame buffer provides PWM data to the PWM engine for generating PWM pulses that drives the LED array.

In another embodiment of the method for increasing dynamic range of an LED display, the step of filling the bit in PWM_$M_I$ with integer one includes filling the bit with integer one regardless of the current value stored in the bit. The bit is reserved for receiving integer one from the addition operation in the case of when the sum of addition equals to or is larger than integer one, otherwise the value of the bit remains to be zero.

In another embodiment of the method for increasing dynamic range of an LED display, the PWM engine generates PWM pulses in a way in which a number of pulses are generated for each non-zero bit in PWM_$M_I$ wherein the number of pulses is in accordance with the designated value of the non-zero bit, no pulse is generated for each bit in PWM_$M_I$ that carries integer zero, and no pulse is generated for each bit in PWM_$M_F$ regardless of the value in each bit of PWM_$M_F$.

DESCRIPTIONS OF DRAWINGS

The teachings of the present disclosure can be readily understood by considering the following detailed description in conjunction with the accompanying drawings.

DETAILED DESCRIPTION OF THE EMBODIMENT

The Figures (FIG.) and the following description relate to the embodiments of the present disclosure by way of illustration only. It should be noted that from the following discussion, alternative embodiments of the structures and methods disclosed herein will be readily recognized as viable alternatives that may be employed without departing from the principles of the claimed inventions.

Reference will now be made in detail to several embodiments of the present disclosure(s), examples of which are illustrated in the accompanying figures. It is noted that wherever practicable similar or like reference numbers may be used in the figures and may indicate similar or like functionality. The figures depict embodiments of the present disclosure for purposes of illustration only. One skilled in the art will readily recognize from the following description that alternative embodiments of the structures and methods illustrated herein may be employed without departing from the principles of the disclosure described herein.

Figure 1:
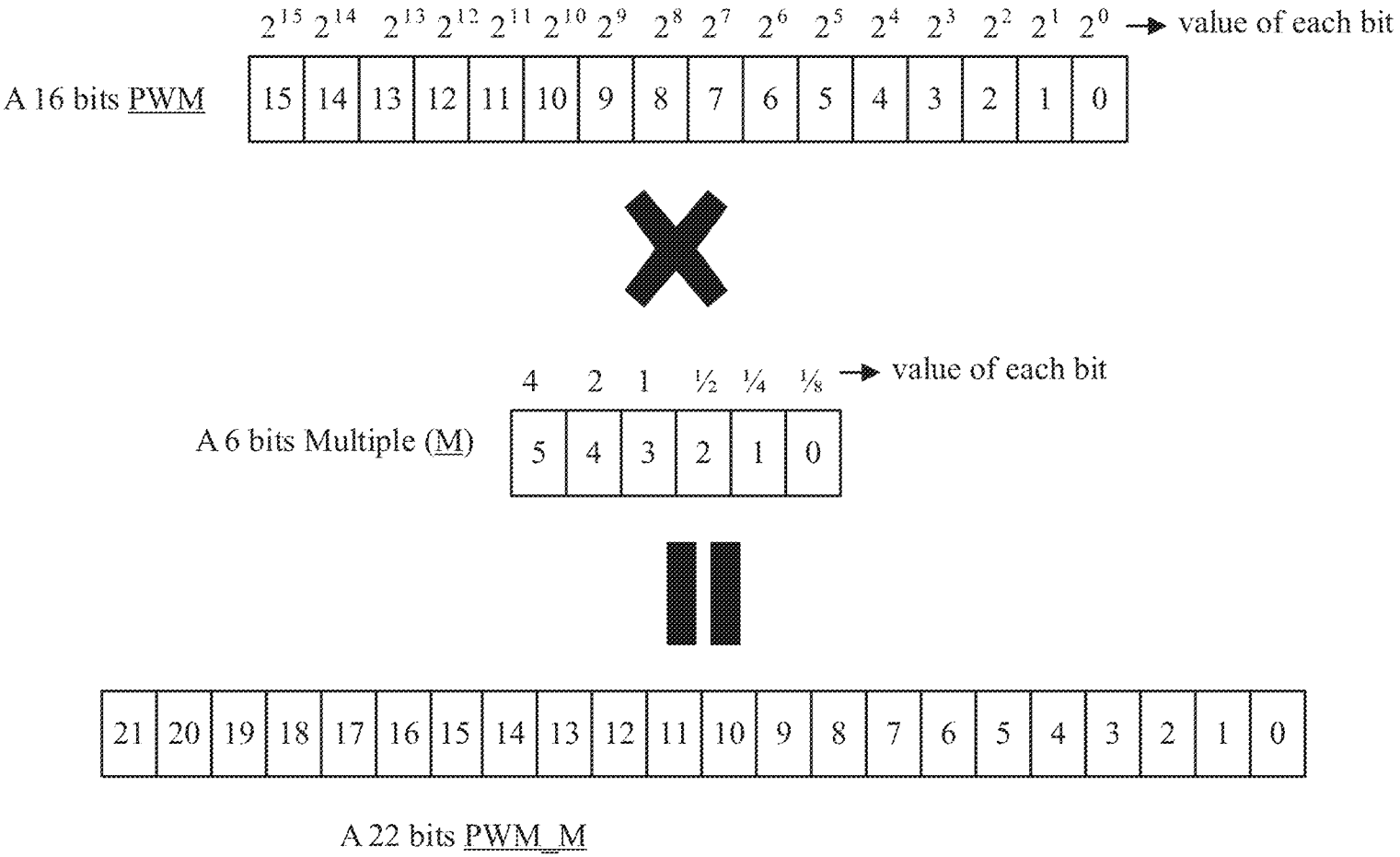
FIG. 1 is a diagram illustrating data arrangement of image data PWM and Multiple (M), and new image data PWM_M after M being applied to PWM.

One aspect of the embodiment according to the current disclosure is illustrated in FIG. 1, which shows image data (PWM) that has a bit depth of 16 and a 6-bit Multiple (M). In M, bits 5, 4, and 3 are designated for the integer section while bits 2, 1, and 0 are designated for the fraction section. By multiplying the 16 PWM bits with 6 M bits, the product (PWM_M) has 22 bits, which is divided into a 19-bit integer part ($PWM_M_I$) and a 3-bit fraction part ($PWM_M_F$). Note that the bit depth of the image data and of the multiple M can be values other than 16 or 6 but may also be other integer of bits in size depending on circumstances and/or needs. The integer section or the fraction section in M may have less or more bits, and the bit number of the integer section in M and the bit number of the fraction section in M may or may not be the same.

In the embodiment of FIG. 1, the addition of 3 bits in the integer section increases the maximum brightness from $2^{16}$ to $2^{19}$, representing a8-time ($2^{19}/2^{16}=2^3=8$) increase from the original size of the 16-bit depth of the image data. Likewise, the 3-bit binary fraction may reduce the PWM to ⅛ ($2^{-3}$) of the original value of the image data. However, in the embodiments of this disclosure, the fraction section is accumulated in an accumulator, which could be a register. Once the value in the accumulator reaches or exceeds the value of "1", "1" is subtracted from the value. Accordingly, in frames having the accumulative fraction value of "1" or more, the display may be lit for one additional PWM pulse; while in frames in which the accumulative value of the fraction section is one or zero, the display does not have an additional pulse.

In a different implementation, if the fraction number in all the image frames is ½ (value in Bit 2 of M is 1), one pulse is displayed every other frame. If the fraction number in the all image frames is ¼ (value in Bit 1 of M is 1), one additional pulse is displayed every 4 frames. If the fraction number in the all image frames is ⅛ (value in Bit 0 of M is 1), one additional pulse is displayed every 8 frames. Note that in other data arrangements of the fraction section in the image frames, the fraction number in the image frames can be the same or different and could be any fractions such as ½, ¼, ⅛, and 1/16, etc. For example, if the fraction number in the image frames is 1/16, one additional pulse is displayed every 16 frames. The even spreading of one pulse across multiple frames increases the granularity of the gray of the image illuminated by the array of LEDs.

Figure 2:
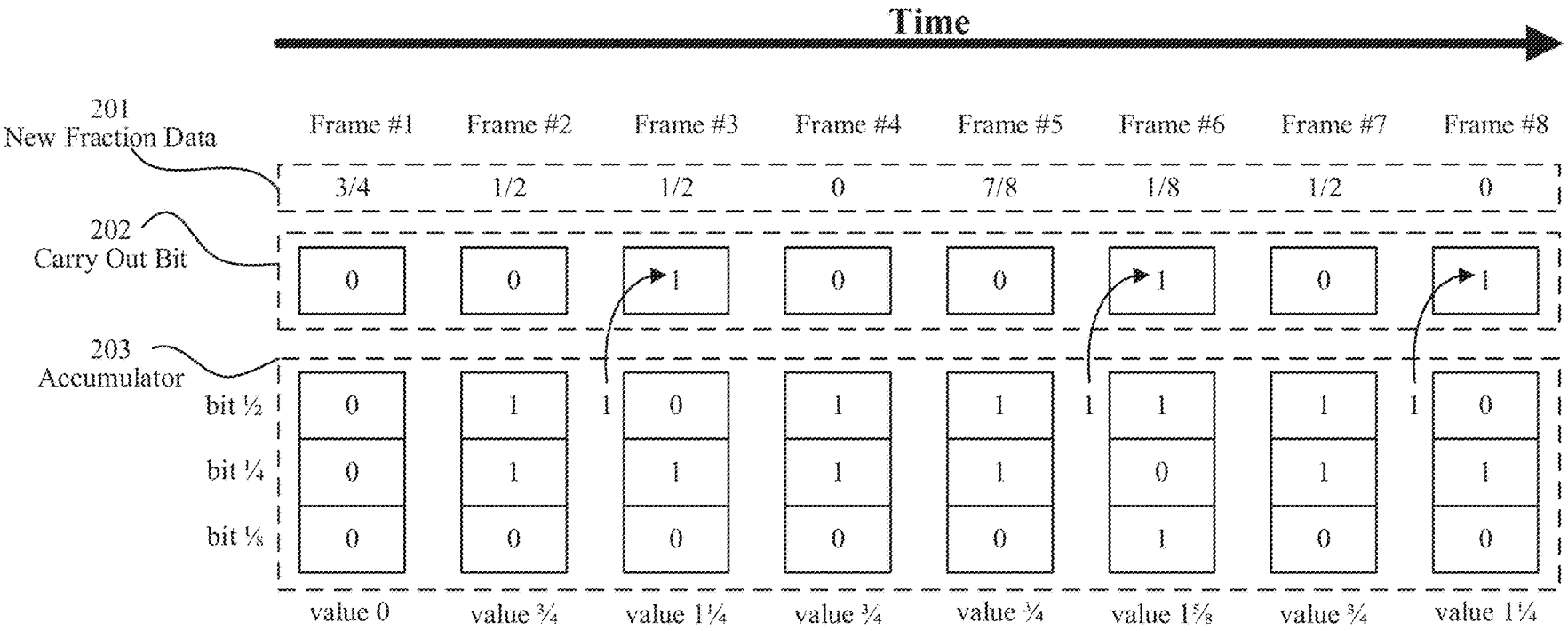
FIG. 2 is a diagram illustrating an example of how the accumulator operates for an individual LED.

FIG. 2 shows an example of how the accumulator operates for an LED. An accumulator 203 operates on the fraction section of frame data as time progresses along the shown direction of a time axis (i.e., from the left to the right wherein frames 1 to 8 consecutively shows up as time progresses, each carrying its own fraction data 201). The three bits of the accumulator, from the bottom up, represents the value of ⅛, ¼, and ½, respectively, has an initial value of 0. Frame #1 has a fraction value of ¾ (0.110 in binary format). After the accumulator 203 adds its initial value of 0 with the fraction value of ¾ brought in by Frame #1, no PWM pulse is displayed as the outcome (¾) of the addition is less than 1. Yet the fraction value of ¾ is stored in the accumulator 203.

Frame #2 has a fraction value of ½ (0.100 in binary format). When the fraction value is added to ¾ stored in the accumulator 203, the outcome is 1¼. Therefore, integer "1" is subtracted from the accumulator so that the remainder in the accumulator 203 is ¼ (0.010 in binary format) while the integer "1" as a carry-out value that is used to populate a carry-out bit 202 in the integer section of $PWM_M_I$.

Frame #3 carries a fraction section with a value of ½ (0.100 in binary format), which is added to ¼ remaining in the accumulator 203 to produce a value of ¾ (0.110 in binary format) in the accumulator 203 for Frame #3. Since Frame #4 has a fraction value of 0 (0.000 in binary format), adding the fraction value of 0 to the remaining value in the accumulator 203 does not change the remaining value in the accumulator 203. Therefore, the remaining value in the accumulator 203 when Frame #4 is being processed remains ¾ (0.110 in binary format).

Frame #5 has a fraction value of ⅞ (0.111 in binary format), and adding this fraction value to the remaining value in the accumulator 203—¾ (0.110 in binary format) yields a value of 1⅝. Therefore, integer "1" is subtracted from the accumulator so that the remainder in the accumulator is ⅝ (0.101 in binary format), while the integer "1" as a carry-out value to populate the carry-out bit 202 in the integer section of $PWM_M_I$.

Frame #6 has a fraction value of ⅛ (0.001 in binary format), which is added to the remaining value in the accumulator is ⅝ (0.101 in binary format) to yield a value of ¾ (0.110 in binary format). Frame #7 has a fraction value of ½ (0.100 in binary format). Adding this fraction value to the remaining value in the accumulator—¾ (0.110 in binary format) yields a value of 1¼. Accordingly, integer "1" is subtracted from the accumulator 203 so that the remainder in the accumulator is ¼ (0.010 in binary format), with the integer "1" as a carry-out value that is used to populate the carry-out bit 202 in the integer section of $PWM_M_I$. Since Frame #8 has a fraction value of 0 (0.000 in binary format), adding the fraction value of 0 to the remaining value in the accumulator 203 does not change the remaining value in the accumulator 203.

As shown in the above description and in FIG. 2, each new frame updates the value in the accumulator 203. If the value reaches 1 or more, 1 is subtracted from the accumulator 203 and the remainder stays in the accumulator 203.

Figure 3:
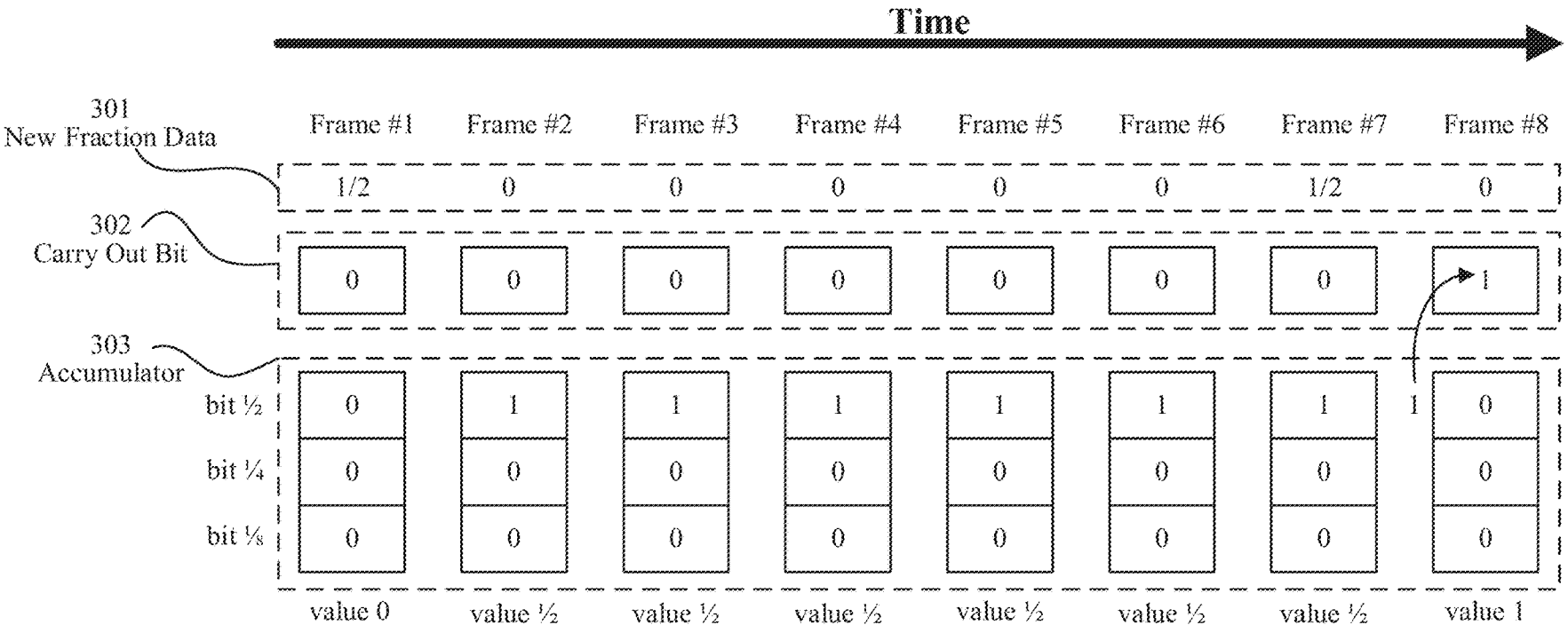
FIG. 3 is a diagram illustrating another example of how the accumulator operates for an individual LED.

FIG. 3, like FIG. 2, shows the same operation an accumulator 303 as time progress along the shown time axis (i.e., from left to right wherein frames 1 to 8 consecutively shows up as time progresses, each carrying its own fraction data 301). In this case, since Frames #2 to #6 all have fraction value of 0, only Frame #8 receives one additional PWM pulse after the accumulator adds the value of ½ brought in by Frame #1 with the value of ½ brought in by Frame #7 which leads a carry-out integer "1" to be stored in a carry-out bit 302 in the PWM_$M_I$, and the value "1" stored in the carry out bit 302 in the PWM_$M_I$ prompts the PWM engine to produce an additional pulse.

It is noted that, although both FIG. 2 and FIG. 3 show the fraction value of image data of frames is up to the granularity of "⅛" (as opposed to more granular fraction value such as "1/16" or "1/32", or less granular fraction value such as "¼" or "½"), the fraction value of image data of frames can have any practical granularity. It is also noted that, although both FIG. 2 and FIG. 3 show the three bits in the fraction section of the accumulator represent the value of "⅛", "¼", and "½", from the bottom to the up, respectively, other operable arrangements can be used, such as the fraction section of the accumulator having less or more bits or each bit of the fraction section of the accumulator representing different values from the ones shown in FIG. 2 and FIG. 3.

Figure 4:
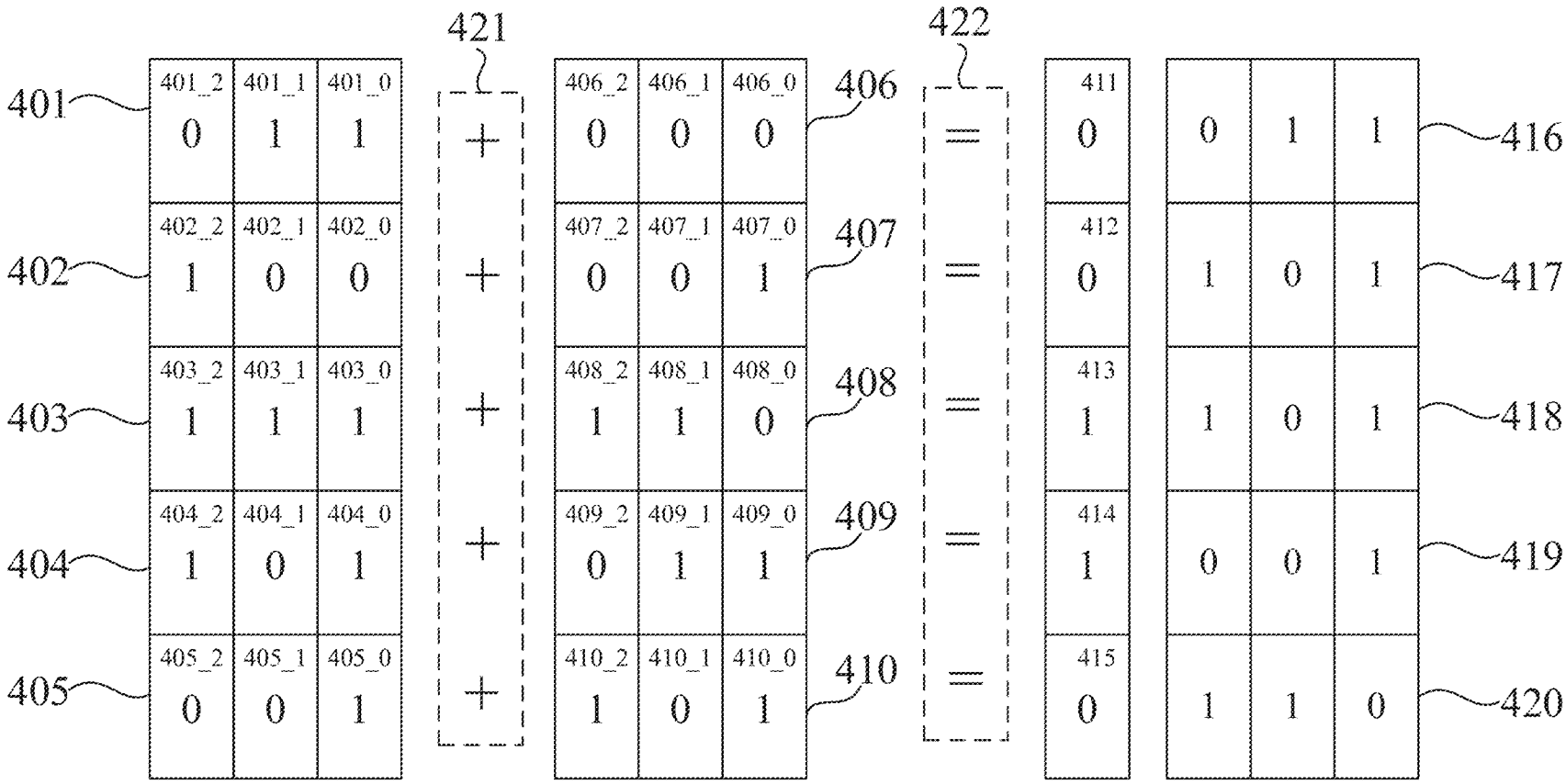
FIG. 4 is a diagram illustrating an example of an operation of an array of 5 LEDs.

FIG. 4 shows the operation of 5 LED pixels according to this embodiment. Each of them has a corresponding accumulator, which accumulates (or adds) the fraction value by adding the fraction value of the new frame to the fraction value stored in the accumulator. When the output from the accumulator is equal to or larger than "1", "1" is "carried out" and used to fill a bit of integer section of the image data (i.e., PWM_$M_I$). After the PWM engine process the PWM data, one additional PWM pulse is delivered to the LED in accordance with the "1" value being filled in the bit of integer section of the image data.

Specifically, FIG. 4 shows 5 LED pixels each having its own fraction section (401, 402, 403, 404, and 405, respectively) for a new frame. In the fraction section 401 for LED #1, it has three separate bits of 401_0, 401_1, and 401_2 each representing the values of "⅛", "¼", and "½", respectively. Likewise, the fraction sections 402, 403, 404, and 405 all have the same arrangement as that of section 401. As noted above, the number of bits and the designated value of bits are not limited to what are shown in FIG. 4. Further, the fraction sections may or may not have data arrangement that are different from each other.

In addition to the five fraction sections of a new frame, FIG. 4 shows five accumulators, each storing values of the fraction section for the current frame data of the five LEDs. In the accumulator 406, there are three bits 406_0, 406_1, and 406_2 each having a designated value of "⅛", "¼", and "½" respectively. Likewise, accumulators 407, 408, 409, and 410 all have the same arrangement as what accumulator 406 has. The arrangements of 406, 407, 408, 409, and 410 may or may not be the same with each other. Nonetheless, in order to carry on the addition operation between the value of a fraction section of the new frame data of a particular LED that is used by the LED on the part of the accumulator, each accumulator's arrangement must match (in terms of the number of bits therein, and the designated value of each bit) what its corresponding fraction of the new frame data for a particular LED. Namely, the arrangement of accumulator 406 must match the fraction section 401 for the new frame data of LED #1; the arrangement of accumulator 407 must match the fraction section 402 for the new frame data of LED #2; the arrangement of accumulator 408 must match the fraction section 403 for the new frame data of LED #3; the arrangement of accumulator 409 must match the fraction section 404 for the new frame data of LED #4; and the arrangement of accumulator 410 must match the fraction section 405 for the new frame data of LED #5.

FIG. 4 also shows five carry-out bits 411, 412, 413, 414, and 415, each of them is part of the PWM_$M_I$ of the image data corresponding to LED #1, LED #2, LED #3, LED #4, and LED #5, respectively. The five carry-out bits are specially reserved to store the value of "1" when the addition operation of a fraction section of the new frame data of a particular LED and the current value in the accumulator corresponding to the LED yields a value of "1" or larger value. In the case when a carry-out bit is filled with value "1", the PWM engine, when processing the newly calculated image data, produces an additional pulse as the intended effect of having value "1" in the carry-out bit. In the case when the carry-out bit is filled with value "0" (the default value), the PWM engine, when processing the newly calculated image data, produces no additional pulse as the intended effect of having value "0" filled in the carry-out bit. Once the value "1" in a carry-out bit is read by the PWM engine to produce an additional pulse, the value in the carry-out bit is reverted to its default value "0". In other words, the carry-out bit acts a placeholder holding an "on/off" flag (corresponding to "1" or "0") to signal the PWM engine to produce or not to produce an additional pulse when reading a newly calculated frame data. The bit has no accumulative effect on data from one frame to its subsequent frame by reverting its value to "0" every time it is used by the PWM engine.

Taking the addition operation (symbolized by 421) upon the data stored in 401 and 406 as an example, the addition operation is conducted in the accumulator 406 corresponding to LED #1 yields (symbolized by 422) a value of ⅜ ("0.011" in binary format) (⅜+0=⅜). This value is represented as 0.011 in binary format and used to replace the value of 0.000 in 416 (note, now the 416 reflects of the state of the accumulator after the addition operation), and the corresponding carry-out bit 411 does not receive a carry-out value of "1" and thus remains "0". Similarly, the addition operations upon the data stored in 402 and 407 as well as the addition operations upon the data stored in 405 and 410 yield a value less than "1". As such, even though the accumulators 407 and 410 bits are updated with the newly calculated fraction values "⅝" ("0.101" in binary format), "¾" ("0.110" in binary format), respectively. Their corresponding carry-out bits, 412 and 415, respectively, do not receive a carry-out value "1" and thus have their default values "0" remained.

Taking the addition operation upon the data stored in 403 and 408 as another example, the addition operation conducted in the accumulator 408 corresponding to LED #3 yields a value of 1⅜ (1.101 in binary format) (⅞+¾=1⅜), and the remaining value, after subtracting the value "1" (which is advanced to the carry-out bit 413) from the yield, is represented as "0.101" in binary format and used to replace the value of "0.110" in 408. Thus, the corresponding carry-out bit 413 receives a carry-out value of "1". Similarly, the addition operation upon the data stored in 404 and 409 yields "1.001", a value larger than "1", causing the corresponding carry-out bit 414 to receive a carry-out value "1" and updating the fraction section of the new frame data 419 with "0.001" (the remaining value after the addition's yield is subtracted with "1").

The time sequence of the above-described events represented by $T_0$, $T_1$, and $T_2$ indicates that at the time of $T_0$, accumulators 406, 407, 408, 409, and 410 each holds its current values ("0.000", "0.001", "0.110", "0.011", and "0.101", respectively). At $T_1$, the five fraction sections of the image data of the five LEDs (401, 402, 403, 404, and 405) become available, and the outcome of the addition operations are produced at $T_2$.

Figure 5:
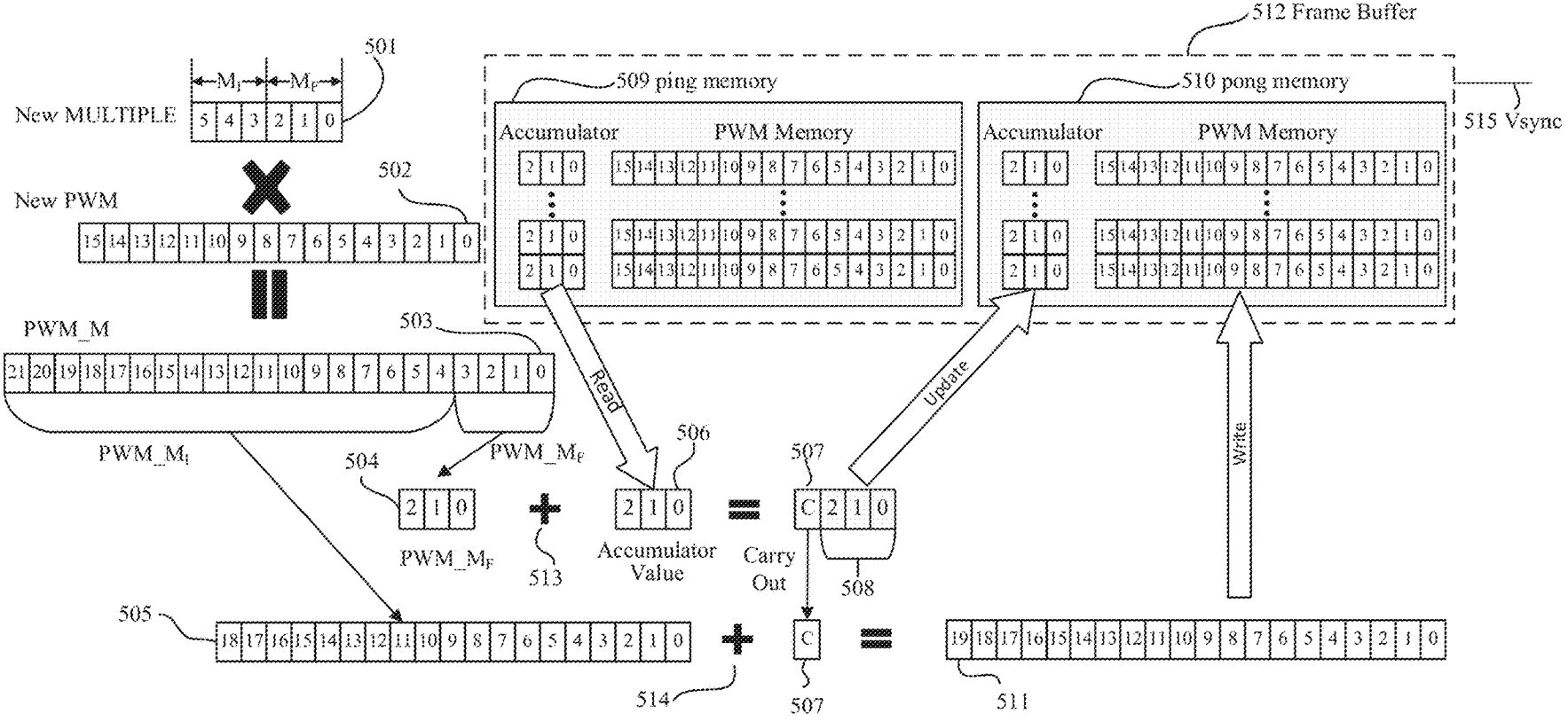
FIG. 5 is a diagram illustrating a detailed data arrangement of image data (PWM) and Multiple (M), and the product of manipulations upon them.

FIG. 5 more comprehensively illustrates one embodiment of the data arrangements of Multiple (M) stored in a storage device 501, image data (PWM) stored in a storage device 502, and extended image data (PWM_M) stored in a storage device 503. The storage device 501, 502, or 503 can be a register or a memory. In this embodiment, 501 storing data M data, has 6 bits, among which 3 bits are allocated to an integer section $M_I$ (Integer) and another 3 bits are allocated to a fraction section $M_F$ (Fraction). Storage device 502, storing input PWM data, has 16 bits while 503 has 22 bits and stores PWM_M data. The product of PWM and M, PWM_M, has 22 bits (bit #0 to bit #21). The integer section of PWM_$M_I$ stored in the storage device 505 ranges from bit #3 to bit #21; while the fraction section PWM_$M_F$ stored in the storage device 504 ranges from bit #0 to bit #2. The accumulator 506 has 3 bits, matching the number of bits in PWM_$M_F$.

As described in FIG. 4, when the value of a PWM_$M_F$ is added to the value of an accumulator, the sum thereof is used to update the value of the accumulator and to fill integer "1" to a carry-out bit when the sum's value equals to or is larger than 1. In FIG. 5, the carry-out bit 507 may be filled with the advancing portion (i.e., integer "1") of the sum, and the value of 506 is updated with the remainder to become 508. Moreover, the array of data in 505 that stores PWM_$M_I$ data is concatenated with the carry-out bit 507 to form an extended array storage 511 for PWM_$M_I$. The resulting PWM_$M_I$ is extended to having 20 bits as opposed to its original size of 19, as shown in 505.

Panels 509 and 510, as two separate and collaborating parts of Frame Buffer 512, are schematic diagrams representing an array of image data for an LED, in which, each LED has a 3-bit long accumulator and a 19-bit long PWM_$M_I$. It is noted that in this embodiment, for each LED, its PWM_$M_F$ is not stored in the PWM Memory in 509 or 510, but rather is cumulatively stored in the accumulator of the LED. As shown in FIG. 5, the data stored in 504 are not read by a PWM engine to produce pulses (the engine only reads data in a PWM_$M_I$ to determine how many pulses to produce). Nevertheless, a new fraction data for an LED stored in 504 is added (via an addition operation 513) with the current value of an accumulator 506 for the particular LED, yielding a sum. In the case that the sum equals or exceeds "1", integer "1" is carried out and fills the carry-out bit 507 for the LED, and the remainder of the sum after subtracting "1" is stored store in 508. In other words, although the carry-out bit 507 is summed with (via operation 507, i.e. "binary add") with the integer part of PWM Memory (which only stores the value of the PWM_$M_I$) and produces extended PWM_$M_I$ 511, which is written into frame buffer 512 (PWM Memory in the pong memory in particular), it mathematically represents the accumulative value of the fraction section of all frames that have been made available to the PWM engine. This data arrangement effectively increases grayscale range of LED display's image with easy implementation and insignificant increase of memory usage.

In one embodiment, the Frame Buffer 512 is arranged to be bisected as ping memory 509 and a pong memory 510. The ping memory 509 stores an array of 20 bits long PWM_$M_I$ data (each of which serves one LED), and an array of 3 bit long accumulator data (each of which serves one LED as well). Likewise, in terms of data arrangement, the pong memory 510 stores an array of 20 bit long PWM_$M_I$ data (each of which serves one LED), and an array of 3 bit long accumulator (each of which serves one LED as well). In fact, the function of the ping memory 509 and the pong memory 510 are different. In one particular frame time, the PWM memory in ping memory 509 is used to trigger the displaying of corresponding LEDs. And, meanwhile, the pong memory 510 is receiving the updated data. Also, the ping memory 509 supplies an array of accumulator data such as 506 to the addition operation 513 upon the PWM_$M_F$ 504 (which is the fraction part of the result of the multiplication of new MULTIPLE 501 and a new PWM 502) to yield a carry-out value (if any) stored in 507 and a remaining fraction value in 508. The value stored in the accumulator 508 is then used to update a corresponding accumulator in the pong memory 510, and the value (either "0" or "1") in the carry-out bit 507 is summed (i.e., binary add) (operation 514) with PWM_$M_I$ 505 to produce the extended PWM_$M_I$ 511, which is then written to a corresponding PWM memory in the pong memory 510.

When current frame finishes displaying and all new frame data finish transferring and stored in frame buffer, a frame change signal $V_{sync}$ 515 toggles and the roles of the pong memory 510 and the ping memory 509 reverse. Upon the reversal of the roles, the PWM memory of the pong memory 510 is used to trigger the displaying of corresponding LEDs, and the ping memory 509 is used to receive updated data of the coming frame. In the other words, the pong memory 510 supplies an array of accumulator data such as 506 to the addition operation 513 upon the PWM_$M_F$ 504 which yields a carry-out value (if any) stored in 507 and a remaining fraction value in 508. The 508 is used to update a corresponding accumulator in the ping memory 509. The new PWM_$M_I$ stored in 505 is added (operation 514) with the carry-out bit 507 from operation 513. The result of addition (514) goes through 511 and is written into a corresponding PWM memory of the ping memory 509. When the frame change signal $V_{sync}$ 515 toggles again, the roles of the ping memory 509 and the pong memory 510 get reversed again. One skilled in the art would understand that the above-mentioned ping-pong memory arrangement may have variants that carry the principle of using minimal memory footprint to effectively achieve what is intended to achieve by using the memories.

Figure 6:
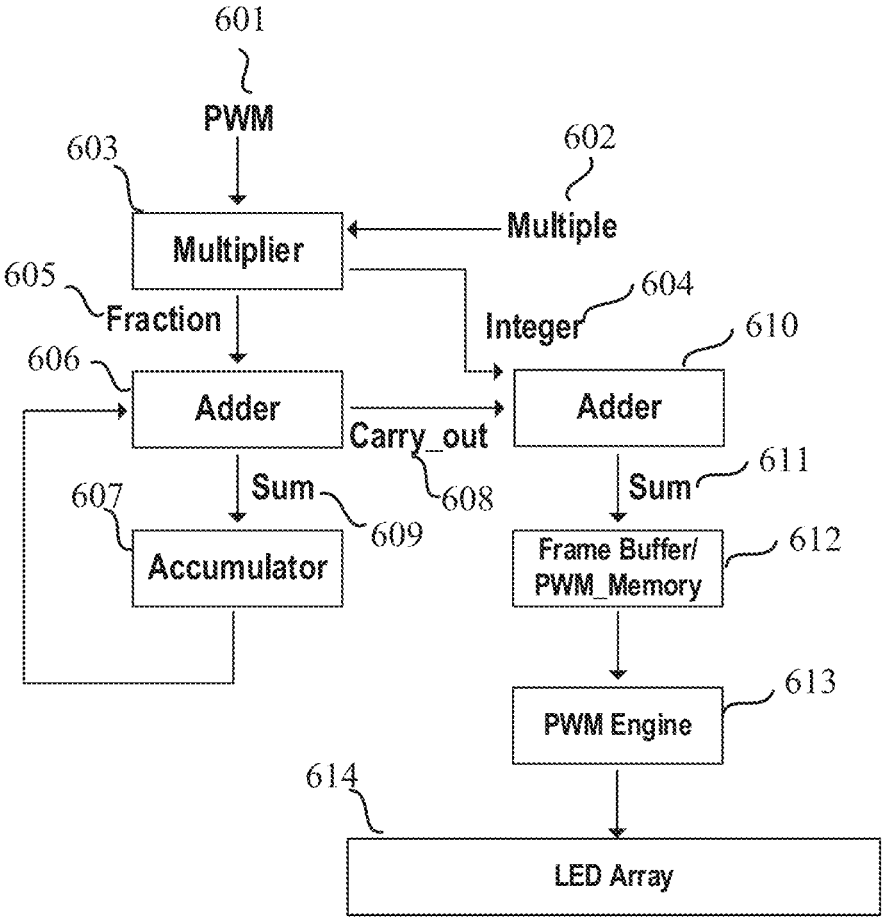
FIG. 6 is a schematic flow chart of the PWM data process, and the flow chart shows the overall composition of a LED display system with dynamic range extender.

FIG. 6 schematically illustrates a flow chart of the PWM data process in an exemplary LED display system with the dynamic range extender circuitry. The new PWM data 601 and Multiple value 602 are inputted to the binary Multiplier 603. The product of 603 is divided into integer part 604 and fraction part 605. Fraction part 605 and the content of accumulator 607 are inputted to the binary adder 606 and the output carry-out 608 and sum 609. The addition sum 609 from 606 is store in Accumulator 607. The carry-out 608 is sent to a second binary adder 610 to be added to the integer part 604 of the product from 603. Then the addition sum 611 is stored in frame buffer/pwm_memory 612. PWM_Engine 613 generates PWM pulses based on the PWM data in frame buffer/pwm_memory 612. The LED array 614 is driven by the PWM pulses from PWM_Engine 613.

Note that using the fraction number to turn on the LED only when its accumulative value equals or exceeds 1 is also applicable without multiplication between the PWM and the multiple (M). For example, one pulse can be equally dithered into eight frames so that each frame receives ⅛ pulse. The conventional method to put ⅛ pulse in one frame requires 8×CLK speed. In comparison, one pulse in 8 frames need only 1×CLK speed.

Many modifications and other embodiments of this disclosure will come to the mind of one skilled in the art having the benefit of the teaching presented in the forgoing descriptions and the associated drawings. For example, the capacity of image data (PWM), Multiple (M), and extended image data (PWM_M) can be expanded or contracted to fit the need and/or circumstance, the designation of value of each bit in PWM, PWM_M, and M can be altered to suit one's preference, the allocation of bits between the integrate section and fraction section of PWM, M, and PWM_M can be adjust according to technical considerations, the threshold for advancing the sum of the value stored in a PWM_$M_I$ and the value stored in an accumulator can be adjusted (in the shown embodiments, the threshold is "1") to a more nuanced value (such as "1⅛", "1¼", "⅞") to satisfy technical circumstances, an accumulator is implemented in a means other than a register indicated in the description. Such variations are within the scope of this disclosure. It is to be understood that the disclosure is not to be limited to the specific embodiments disclosed, and that the modifications and embodiments are intended to be included within the scope of the dependent claims.

What is claimed is:

1. An LED display system, comprising:

an array of LEDs;

a driver circuit configured to drive the array of LEDs, wherein the driver circuit comprises a PWM engine, an adder, an accumulator, a multiplier, and a frame buffer, wherein, during operation, the multiplier multiplies an image data of a first bit depth (PWM) with a multiple (M) to produce an input data (PWM_M) having a second bit depth, wherein the multiple has an integer section ($M_I$) of one or more bit in length and a fraction section ($M_F$) of one or more bit in length, wherein the input data has an integer section (PWM_$M_I$) and a fraction section (PWM_$M_F$);

the adder adds a value of PWM_$M_F$ of a current input data with a value of a remainder in an accumulator, and when a sum of the addition operation is less than one, updating the remainder to equal the sum of the addition; when the sum of the addition equals to or is larger than integer one, subtracting integer one from the sum of the addition and updating the remainder to equal a result of the subtraction, and adding integer one to a bit in PWM_$M_I$, and sending the resulting PWM_$M_I$ to the frame buffer, and the PWM engine receives PMW data from the frame buffer and generates PWM pulses to drive the LED array.

2. The LED display system according to claim 1, wherein adding integer one to PWM_$M_I$ comprises adding integer one regardless the current value stored in the bit, wherein the bit is specifically reserved for receiving integer one from the addition operation when the sum of addition equals to or is larger than integer one, otherwise the value of the bit remains to be zero.

3. The LED display system according to claim 1, wherein the PWM engine generates PWM pulses in a manner that a number of pulses are generated for each non-zero bit in PWM_$M_I$ according to the current value of the non-zero bit; no pulse is generated for each bit in PWM_$M_I$ that carries integer zero; and no pulse is generated for each bit in PWM_$M_F$.

4. The LED display system according to claim 1, wherein the PWM engine generates PWM pulses in a manner that a number of pulses are generated for each non-zero bit in PWM_$M_I$ according to the current value of the non-zero bit; no pulse is generated for each bit in PWM_$M_I$ that carries integer zero; and no pulse is generated for each bit in PWM_$M_F$, and a full pulse is generated for each non-zero bit in PWM_$M_F$.

5. The LED display system according to claim 1, wherein the driver circuit further comprises a frame buffer that stores current accumulator data, current PWM_$M_I$ data, updated accumulator data, and updated PWM_$M_I$ data.

6. The LED display system according to claim 5, wherein the frame buffer comprises a ping memory and a pong memory, wherein the ping memory stores current accumulator data and current PWM_$M_I$ data, wherein the ping memory provides the current accumulator data for the addition operation, wherein the pong memory receives updated accumulator data and updated PWM_$M_I$ data from the addition operation, and wherein the pong memory stores updated accumulator data and updated PWM_$M_I$ data.

7. The LED display system according to claim 6, wherein the ping memory becomes the pong memory and the pong memory becomes the ping memory after the pong memory receives all new frame data and the ping memory finishes current frame displaying and a frame change signal $V_{sync}$ occurs.

8. A method for increasing dynamic range of an LED display, comprising: multiplying an image data of a first bit depth (PWM) with a multiple (M) to produce an input data (PWM_M) having a second bit depth, wherein the multiple has an integer section ($M_I$) of one or more bit in length and a fraction section ($M_F$) of one or more bit in length, wherein the input data has an integer section (PWM_$M_I$) and a fraction section (PWM_$M_F$);

conducting an addition operation on a value of PWM_$M_F$ of a current input data and the value of a remainder in an accumulator, when a sum of the addition operation is less than one, updating the remainder to equal the sum of the addition; when the sum of the addition equals to or is larger than integer one, subtracting integer one from the sum of the addition and updating the remainder to equal a result of the subtraction, and adding integer one to a bit in PWM_$M_I$;

sending the value of PWM_$M_I$ to a frame buffer that supplies PWM data to a PWM engine; and producing PWM pulses in the PWM engine to drive the LED display.

9. The method for increasing dynamic range of an LED display according to claim 8, wherein the step of adding integer one to the bit in PWM_$M_I$ comprises of adding integer one to the bit regardless of the current value stored in the bit, and the bit is specifically reserved for receiving integer one from the addition operation when the sum of addition equals to or is larger than integer one, otherwise the value of the bit remains to be zero.

10. The method according to claim 8, wherein the PWM engine generates PWM pulses in a manner that a number of pulses are generated for each non-zero bit in PWM_$M_I$ according to the current value of the non-zero bit; no pulse is generated for each bit in PWM_$M_I$ that carries integer zero; and no pulse is generated for each bit in PWM_$M_F$.

11. The method for increasing dynamic range of an LED display according to claim 8, wherein the PWM engine generates PWM pulses in a manner that a number of pulses are generated for each non-zero bit in PWM_$M_I$ according to the current value of the non-zero bit; no pulse is generated for each bit in PWM_$M_I$ that carries integer zero; and no pulse is generated for each bit in PWM_$M_F$, and a full pulse is generated for each non-zero bit in PWM_$M_F$.

12. The method for increasing dynamic range of an LED display according to claim 8, further comprising storing current accumulator data, current PWM_$M_I$ data, updated accumulator data, and updated PWM_$M_I$ data in a frame buffer in a driver circuit that drives the LED display.

13. The method for increasing dynamic range of an LED display according to claim 12, wherein the frame buffer comprises a ping memory and a pong memory, wherein the ping memory stores current accumulator data and current PWM_$M_I$ data, wherein the ping memory provides the current accumulator data for the addition operation, wherein the pong memory receives updated accumulator data and updated PWM_$M_I$ data from the addition operation, and wherein the pong memory stores updated accumulator data and updated PWM_$M_I$ data.

14. The method for increasing dynamic range of an LED display according to claim 13, wherein the ping memory becomes the pong memory and the pong memory becomes the ping memory after the pong memory receives all new frame data and the ping memory finishes current frame displaying and a frame change signal $V_{sync}$ occurs.

* * * * *